United States Patent [19]

Jacobson

[11] 4,435,874

[45] Mar. 13, 1984

[54] BLIND CLEANING DEVICE

[76] Inventor: Jeff A. Jacobson, 22 Woodgrove, Irvine, Calif. 92714

[21] Appl. No.: 519,075

[22] Filed: Aug. 1, 1983

[51] Int. Cl.[3] ..... A47L 4/02

[52] U.S. Cl. ..... 15/210 A; D4/8

[58] Field of Search ..... 15/160, 210 A, 394; 401/10; 134/6; D4/1, 8

[56] References Cited

U.S. PATENT DOCUMENTS

| | | | |
|---|---|---|---|
| 2,134,965 | 11/1938 | Zbarsky | 15/210 A |
| 2,172,479 | 9/1939 | McMillen | 15/210 |
| 2,276,264 | 3/1942 | Goldfinger | 15/210 |
| 2,571,906 | 10/1951 | Love | 15/210 |
| 2,856,625 | 10/1958 | Delacretaz | 15/210 A X |
| 2,957,190 | 10/1960 | Stark | 15/121 |
| 4,084,478 | 4/1978 | Bailes et al. | 15/210 |
| 4,400,842 | 8/1983 | Vitonis | 15/210 A |

FOREIGN PATENT DOCUMENTS

| | | | |
|---|---|---|---|
| 1071271 | 6/1967 | United Kingdom | 15/210 |

*Primary Examiner*—Edward L. Roberts

*Attorney, Agent, or Firm*—Poms, Smith, Lande & Rose

[57] ABSTRACT

A blind cleaning device having a handle and a plurality of fixed spaced fingers extending from the handle. Blind cleaning elements are provided on the fingers and the slats of the blind are insertible between the elements. The device includes a central finger extending normal from the handle and angled fingers on each side of the central finger. When the fingers are inserted between the slats of the blind to be cleaned, and moved along the slats, the device efficiently cleans all surfaces of the slats in a single pass. The cleaning elements may be rollers of fake fur or lambs' wool and may be coated with a dust attracting cleaning agent prior to cleaning the blind slats.

14 Claims, 7 Drawing Figures

BLIND CLEANING DEVICE

BACKGROUND OF THE INVENTION

1. Field of the Invention

The invention relates to blind cleaning devices; and, more particularly, to a device insertible between slats of venetian blinds and movable there along to clean the same.

2. Description of the Prior Art

One of the most distasteful household cleaning jobs is the efficient cleaning of venetian blinds or mini-blinds. Unfortunately, such blinds are as popular today as they have been in the past and various devices have been suggested over the years for cleaning the same. In U.S. Pat. No. 2,172,479 to McMillen, a venetian blind duster is shown using fur or hair bristles 14. The bristles merely move dust from one location on the slat to another and bind in the ropes interconnecting the slats.

In U.S. Pat. No. 2,276,264 to Goldfinger, a duster is shown having flexible fingers but the fingers merely flex, cannot be inserted between slats of a blind and do not clamp a blind slat therebetween. In U.S. Pat. No. 2,571,906 to Love, a blind cleaner is disclosed having spring-biased fingers 12 covered with cleaning pads 19. Only two fingers 12 are disclosed, the pads 19 are very close together, the material of pads 19 is not disclosed and the device is relatively expensive to manufacture. Also, contiguous slats cannot be cleaned simultaneously.

In U.S. Pat. No. 2,957,190 to Stark, a louver cleaner is disclosed having sponges 19 for cleaning louvers. Obviously, successive slats cannot be cleaned simultaneously. A similar device which cannot simultaneously clean slats is disclosed in British Pat. No. 1,071,271 to Warner where sponge pads 13, 14 are on only one side of spaced arms 11, 12.

It can thus be seen that none of the prior art patents except McMillen and Goldfinger can simultaneously clean more than two slats at a time. McMillan's bristles are very inefficient and can bind on the ropes interconnecting the blinds. Goldfinger's fingers cannot clasp a plurality of contiguous slats therebetween for simultaneous cleaning thereof. None of the known prior art devices have achieved commercial success due to their ineffectiveness in cleaning blinds.

There thus is a need for an economical and easy to manufacture cleaning device for efficiently cleaning all surfaces of blinds in a single pass and removing dirt and dust therefrom. In my pending U.S. Patent application Ser. No. 443,334 filed Nov. 22, 1982, I disclosed a device wherein the fingers flex to clamp the slats of the blind therebetween. If the fingers are fixed at the proper angle, it is not necessary that they flex.

SUMMARY OF THE INVENTION

It is an object of this invention to provide an improved blind cleaning device which is adapted to clean efficiently and simultaneously a plurality of contiguous blind slats.

It is a further object of this invention to provide such a device which straddles both sides of the slats for efficient cleaning thereof and allows clamping of the slats as the device is inserted until the slats abut against the framework of the device.

It is still another object of this invention to provide such a device having cleaning elements which can be removed for cleaning in ordinary water and may be sprayed or coated with a dust attracting cleaning agent prior to use thereof.

These and other objects are preferably accomplished by providing a blind cleaning device having a handle and a plurality of fixed spaced fingers extending from the handle. Blind cleaning elements are provided on the fingers and the slats of the blind are insertible between the elements. The device includes a central finger extending normal from the handle and angled fingers on each side of the central finger. When the fingers are inserted between the slats of the blind to be cleaned, the slats are clamped between the Vee shape formed between the fingers. The device is then moved along the blind slats, the device efficiently cleans all surfaces of the slats in a single pass. The cleaning elements may be rollers of fake fur or lambs' wool and may be coated with a dust attracting cleaning agent prior to cleaning the blind slats. The flaring of the fingers allows for easier insertion of the slats between the fingers.

DESCRIPTION OF THE PREFERRED EMBODIMENT

Figure 1:
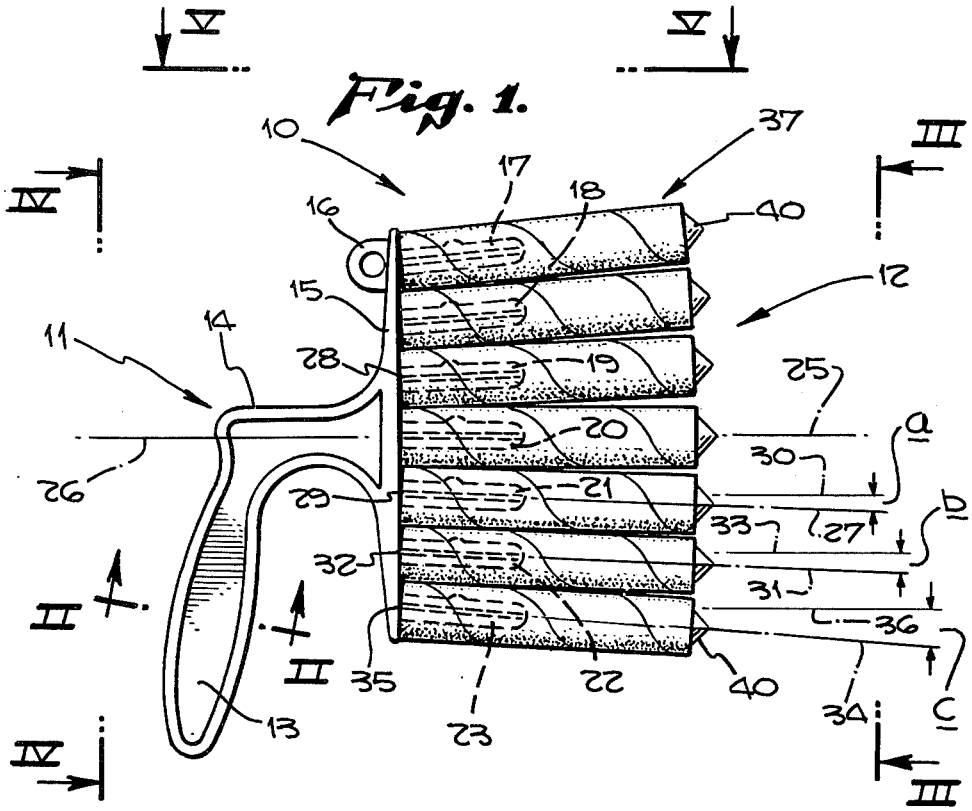
FIG. 1 is a vertical view of a cleaning device in accordance with the invention.
Figure 2:
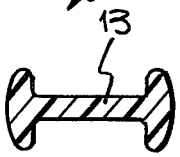
FIG. 2 is a view of the device of FIG. 1 taken along lines II—II thereof.
Figure 4:
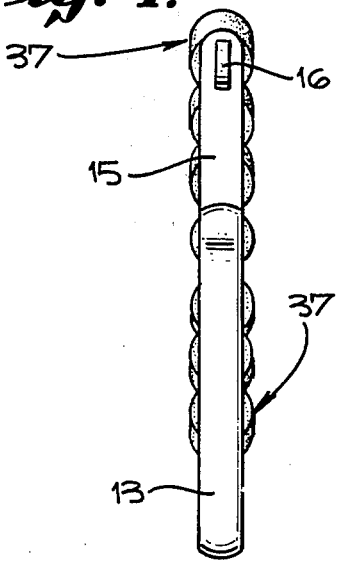
FIG. 4 is a view taken along lines IV—IV of FIG. 1.
Figure 5:
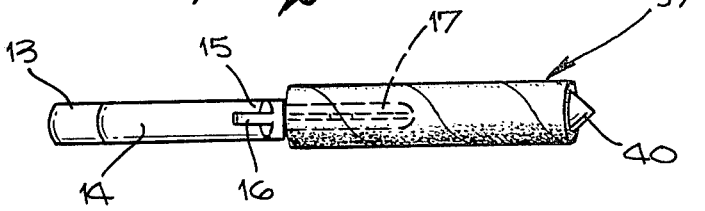
FIG. 5 is a view taken along lines V—V of FIG. 1.

Referring now to FIG. 1 of the drawing, a cleaning device 10 is shown having a hand grip portion 11 and a blind cleaning portion 12. Hand grip portion 11 is comprised of a web-like framework (FIG. 2) having an elongated hand grip portion 13 and main frame portion 14.

An elongated finger support 15 is coupled to portion 14. A generally circular open section 16 may be provided at the upper end of support 15 for hanging device 10 on a hook or the like.

Figure 6:
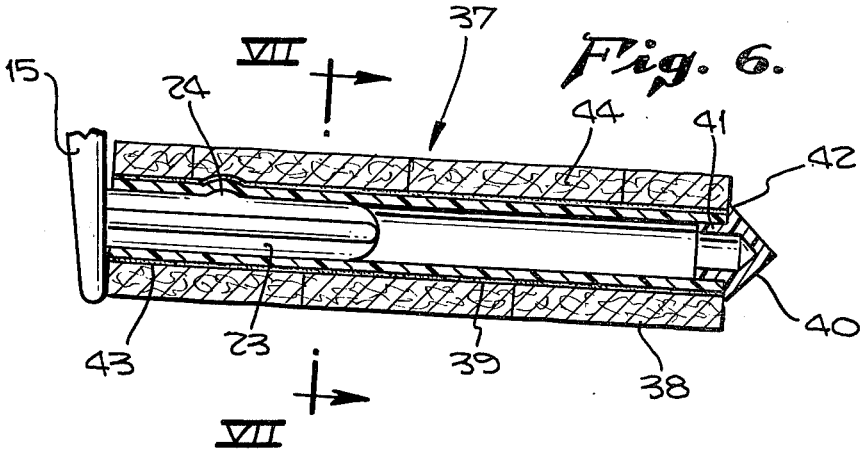
FIG. 6 is a cross-sectional view of one of the fingers with a cleaning tube disposed thereon.

As seen in FIGS. 1 and 6, a plurality of vertically spaced resilient rigid elongated fingers 17 through 23 are integral with and extend from support 15. As shown in FIG. 1, seven such fingers 17 through 23 are illustrated and are preferred for convenience of use. As particularly seen in FIG. 6, each finger 17–23 (only finger 23 being shown in FIG. 6) also includes a bump or boss 24 thereon. Finger 20 is centrally located along support 15. That is, main frame portion 14 joins support 15 at about the midpoint thereof. Finger 20 extends from that midpoint. The central longitudinal axis 25 of finger 20 thus lies along and is coincident with the central axis 26 through portion 14 as shown. Finger 20 therefore extends generally normal to support 15. As seen in both FIGS. 1 and 3, the fingers 19 and 21, on each side of finger 20 are at an angle of about $1\frac{1}{2}°$ with respect to a line 27 extending from the center points 28, 29 of the connection of each fingers 19 and 21, respectively, outwardly at a right angle to the longitudinal axis of support 15 and a line 30 through the central longitudinal axis thereof (making an angle a of approximately 1.5° between lines 27, 30—only the angle for finger 21 being illustrated, the same angle being present in finger 19).

In like manner, fingers 18 and 22, on opposite sides of finger 19 and 21, respectively, have their longitudinal axes at an angle b of about 3° with respect to a line 31 extending from midpoint 32 along their central longitudinal axes and a line 33 extending from midpoint 32 normal to the longitudinal axis of support 15 (only finger 22 being illustrated—finger 18 being identical).

Finally, fingers 17 and 23, on opposite sides of fingers 18 and 22, respectively, have their longitudinal axes at an angle c of about 4.5° with respect to a line 34 extending from midpoint 35 along their central longitudinal axes and a line 36 extending from midpoint 35 normal to the longitudinal axis of support 15 (only finger 23 being illustrated—finger 17 being identical).

Figure 7:
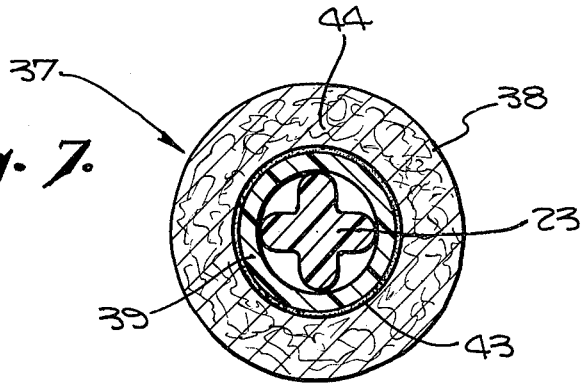
FIG. 7 is a view taken along lines VII—VII of FIG. 6.

As seen in FIGS. 6 and 7, each finger 17 through 23 is generally cross-shaped in cross-section. Also, as seen in FIGS. 1, 3, 4, 5 and 6, hollow tubes 37 such as of cardboard or plastic, are adapted to fit snugly onto each finger 17–23. Each tube 37 includes a cleaning material 38 (FIG. 6) secured on the outer peripheral surface thereof. As seen particularly in FIG. 1, the outer surfaces of adjacent material 38 are contiguous along portions of the length of tubes 37, but material 38 is a generally soft deformable material, as will be discussed, so that the slats of a venetian blind may be disposed therein, and the device 10 moved therealong to clean the same. In other words, as seen in FIG. 1, due to the fixed predetermined angularity of fingers 17–23, when tubes 37 are inserted thereon as shown, a slight spacing is provided between adjacent tubes 37 so that blind slats (not shown) can easily be inserted between adjacent tubes 37 and slats cleaned as described in my copending application Ser. No. 443,334.

Although seven fingers 25 are shown, obviously any suitable number may be used, even as few as two. Also, tubes 37 may snugly fit onto fingers 17–23 but removable therefrom for either replacement or cleaning. For example, the material 38 may be lambs' wool or fake fur of nylon or polyester fiber or the like which will pick up dust and yet can be cleaned in soap and warm water. The fur can of course be glued or otherwise adhered to tubes 27. In addition, the material 38 may be sprayed or otherwise coated with a dust attracting cleaning agent prior to use allowing efficient cleaning. As heretofore stated, known prior art devices, such as bristle-type cleaning devices, merely smear or move the dirt or dust from one area of the blind to another resulting in inefficient cleaning.

The handle portion 13 (and all components save tubes 37 and material 38) may be of a suitable plastic, preferably molded from one piece. For example, the entire handle 13, portions 4 and 15 and fingers 17–23 may be of one piece of molded polypropylene. The tubes 37, as mentioned, may be of cardboard or extruded plastic, such as ABS plastic.

As seen in FIG. 6, the fingers 17 to 23 need not be as long as the overall length of the tubes 37. The bump or boss 24 enables the tube 37 to be easily slid over the bump 24 to insert the tube on the respective finger, and retain it thereon, while permitting easy removal. As also seen in FIG. 6, each tube 37 includes a hollow open-ended cylindrical portion 39 and a pointed removable cap 40 which parts may all be of cardboard or metal or plastic. Cap 40 includes a cylindrical portion 41 which extends into the interior of portion 39 and is retained therein by friction. Cap 40 is pointed or peaked (see also FIG. 3) for providing guide means when inserting the tubes 37 between the blind slats. As also seen in FIG. 6, cap 40 includes a flange 42 of an overall diameter greater than that of the outer diameter of cylindrical portion 39 so that it extends about the periphery thereof. This provides means for preventing the knife edge of the blinds from jamming on or engaging the cylindrical portion 39 or the base of the material. When the tubes 37 are removed, the nape of material 38 reverses and overlies the outer diameter of the cap 40 to prevent the cap 40 from catching on the blind edges. The material 38 includes a base 43 which is adhered to cylindrical portion 39 by a suitable glue or the like. The material 38 also includes the aforementioned lambs' wool or fake fur 44 which may be cut from elongated strips of such material which is then spirally wound (FIG. 1) and glued to base 43. Such strips may, for example, be 1" in width.

As shown in FIG. 1, portion 13 is gripped by the user and the fingers 17–23 are inserted between the slats of a blind and moved along the slats to clean the same. The fur or similar material 38 attracts dust due to its synthetic fibers and static cling inherent therein, and, particularly when sprayed with a dust attracting agent, picks up the dust more efficiently. Of course, any suitable handle may be provided. Although the entire hand grip (framework) 13 and portions 14, 15 fingers 17–23 may be of one-piece molded plastic, obviously the device 10 may be comprised of separate sections integrally secured together.

The device 10 is very comfortable to use and has a convenient grip and fixed finger angle and works efficiently with all types of blinds. Generally, so-called commercial mini-blinds are one inch or so in width and about $\frac{3}{4}$" apart. Conventional venetian blinds are about two inches in width and spaced about 1 and $\frac{5}{8}$ inches apart. The device 10 disclosed herein cleans more than one blind slat at a time no matter what type of slats are being cleaned.

The entire device 10 can be washed in water or the tubes 37 (and adhered material 38) can be removed and replaced or cleaned. In fact, the tubes 37 can be washed in a conventional washer and dryer. Although the device 10 can be used without the addition of a dust attracting cleaning agent, it is particularly well suited to cleaning with such agents.

Although the device 10 has been disclosed with particular reference to cleaning vertical or horizontal blinds and shutters of any suitable material, such as wood, plastic, fabric, etc., it can also be used as a general purpose cleaning device for the tops of doors, pictures, etc.

Figure 3:
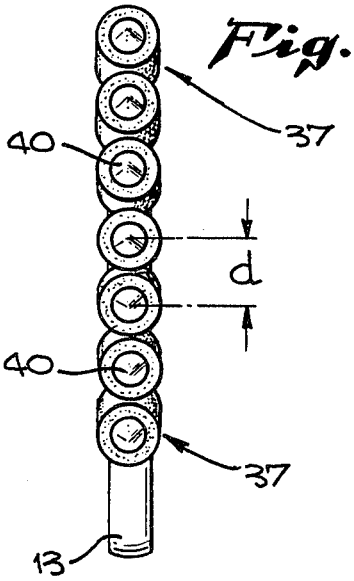
FIG. 3 is a view taken along lines III—III of FIG. 1.

The fixed angularity of fingers 17–23, as seen in FIGS. 1 and 3, forms a spacing between adjacent tubes 37 near the forward ends thereof for easily insertion of the blind slats, the pointed ends 40 assisting in such insertion. The slats then engage material 38 on adjacent fingers near section 15. Since the material 38 is soft and deformable, the slats are inserted until they engage section 15. Thus, a substantial portion of material 38 engages the slats, essentially related to the width of such slats, so that they can be cleaned in a single pass.

Any suitable dimensions may be used. For example, the overall length of tube 37 may be about $3\frac{1}{8}$" with the overall diameter about $\frac{1}{2}$" (i.e., cap 40)—the outer diameter of cylindrical portion 34 may be about 0.438" (+0.005) and its inner diameter about 0.378 (+0.005).

The overall length of end cap 40 may be about 0.5", the length of cylindrical portion 41 being about ¼" and the length of the portion of cap 40 from portion 41 to the tip thereof also being about ¼".

The backing base 43 may be of 100% polyester with material 44 being 97% polyester and 3% acrylic. The thickness of backing material 43 may be about 0.05 inches and the pile height may be about 0.200 inches. The glue may be any suitable glue, such as Beacons 422 manufactured by Stirling Company.

Conventional blind slats are about 0.012 inches in thickness and miniblinds are about 1" in width. Venetian blinds are about 2" in width. The spacing between miniblinds is usually about 0.810 inches and between venetian blinds about 1.62 inches. The pile of material 44 is chosen to give the desired interference for ideal cleaning by providing sufficient friction on the blind slat. The distance between the midpoints of adjacent fingers 17 to 23 along section 15 may be about 0.75". My device is particularly well suited, in the preferred range of dimensions, to clean most types of blinds in a single pass.

The fixed angularity described hereinabove provides a 1.5° difference between adjacent fingers from mid-finger 20. This angularity may vary slightly but should preferably be kept within a range whereby the distance d between adjacent finger tips 40 (FIG. 3) falls within a range of not less than 0.775 inches and not greater than 0.916 inches, about 0.82 inches being preferred.

The fingers 17–23 may be about 1.75" in overall length and about 0.36" in thickness. The bumps 24 may be about 0.035 inches in height and about 0.19 inches in diameter. The web (FIG. 2) may be about 1.35 inches wide and about 0.50 inches thick. It can be seen that I have disclosed a unique and novel cleaning device particularly well suited to the cleaning of mini-blinds, slats or venetian blinds. The fingers are fixed at a pre-determined angle for easily inserting between the slats of a blind. The slats are clamped between the Vee shape formed between the fingers. The flaring of the fingers allows for easier insertion of the slats between the fingers. The pointed ends facilitate entry. The preferred dimensions permit cleaning of most types of blinds in a single pass along the slats.

I claim:

1. In a blind cleaning device having a handle and a plurality of vertically spaced rigid fingers with cleaning elements extending from a vertical support interconnected to the handle, the improvement which comprises:

said fingers includes a first finger fixedly mounted to said vertical support at generally the midpoint thereof, said first finger having its central longitudinal axis perpendicular to the central longitudinal axis of said vertical support, a pair of second and third fingers fixedly mounted to said vertical support on opposite sides of said first finger, each of said second and third fingers having their central longitudinal axes making an angle of about 1.5° with respect to a line extending from the midpoint of each of said second and third fingers at its respective point of connection to said vertical support along its respective central longitudinal axis outwardly normal to the central longitudinal axis of said vertical support whereby insertion of the fingers between slats of a blind is adapted to progressively clamp the slats between adjacent fingers until the slats abut against the vertical support.

2. In the device of claim 2 wherein said fingers further include a pair of fourth and fifth fingers fixedly mounted to said vertical support on opposite sides of said second and third fingers, respectively, each of said fourth and fifth fingers having their central longitudinal axes making an angle of about 3.0° with respect to a line extending from the midpoint of each of said fourth and fifth fingers at its respective point of connection to said vertical support along its respective central longitudinal axis outwardly normal to the central longitudinal axis of said vertical support.

3. In the device of claim 2 wherein said fingers further include a pair of sixth and seventh fingers fixedly mounted to said vertical support on opposite sides of said fourth and fifth fingers, respectively, each of said sixth and seventh fingers having their central longitudinal axes making an angle of about 4.5° with respect to a line extending from the midpoint of each of said second and third fingers at its respective point of connection to said vertical support along its respective central longitudinal axis outwardly normal to the central longitudinal axis of said vertical support.

4. In the device of claim 1 wherein said handle, said vertical support, and said fingers are an integral unitary piece of molded plastic material.

5. In the device of claim 1 wherein each of said fingers is X-shaped in cross-section.

6. In the device of claim 1 wherein said cleaning elements include a removable insert mounted on each of said fingers.

7. In the device of claim 6 wherein each of said inserts includes an elongated tube snugly fitting onto each of said fingers, each of said cleaning elements including a synthetic fur material secured to substantially the entire outer surface of each of said tubes.

8. In the device of claim 7 wherein said tube includes an open-ended cylindrical member having a pointed end at its free end.

9. In the device of claim 8 wherein said fur material is secured to a base secured to the outer surface of said cylindrical member.

10. In the device of claim 8 wherein said pointed end is provided by a cylindrical insert frictionally held in said cylindrical member having a tapered point outside of said member, the apex of said point being coincident with the central longitudinal axis of said finger, the overall diameter of said insert outside of said cylindrical member being greater than the outher diameter of said cylindrical member.

11. In the device of claim 10 wherein the overall height of said fur material is about 0.25 inches.

12. In the device of claim 6 wherein the central longitudinal axes of adjacent fingers at their point of connection to said vertical support are about 0.75 inches apart.

13. In the device of claim 1 wherein the central longitudinal axes of adjacent fingers at their free ends are between about 0.775 and 0.916 inches apart.

14. In the device of claim 13 wherein the central longitudinal axes of adjacent fingers at their free ends are about 0.82 inches apart.

* * * * *